United States Patent [19]

Fujiwara

[11] 4,205,957

[45] Jun. 3, 1980

[54] HEATING ELEMENT

[76] Inventor: Akinobu Fujiwara, 3204 Shimohatsukari Hatsukari-cho, Otsuki City, Yamanashi Prefecture, Japan

[21] Appl. No.: 968,974

[22] Filed: Dec. 13, 1978

[30] Foreign Application Priority Data

Nov. 30, 1978 [JP] Japan ..... 53/143124

[51] Int. Cl.[2] ..... F24J 1/00; F24J 3/00

[52] U.S. Cl. ..... 44/3 R; 44/3 A; 126/263

[58] Field of Search ..... 44/3 R, 3 A, 3 B; 126/263

[56] References Cited

U.S. PATENT DOCUMENTS

| | | | |
|---|---|---|---|
| 3,229,681 | 1/1966 | Gluckstein | 44/3 R |
| 3,301,250 | 1/1967 | Glasser | 44/3 R |
| 4,106,478 | 8/1978 | Higashijima | 44/3 A |
| 4,114,591 | 9/1978 | Nakagawa | 44/3 A |

*Primary Examiner*—Carl F. Dees

*Attorney, Agent, or Firm*—Wenderoth, Lind & Ponack

[57] ABSTRACT

A heating element for use in heater poultices or disposable pocket heaters, which contains oxidizable metallic powders, one of the noble metallic catalysts such as platinum palladium, etc. or a mixture thereof, and a porous catalyst carrier such as active carbon, silica gel, etc. The catalyst carrier may be partially or wholly air-permeably water-proofed by water-repellent, and the surface of the oxidizable metallic powers may be coated with a fatty acid or metallic soap. The electrochemical oxidation reaction of the metallic powders to air is promoted and accelerated by the catalysts to make the metals produce heat energy.

5 Claims, 3 Drawing Figures

HEATING ELEMENT

BACKGROUND OF THE INVENTION

The present invention relates to a heating element in which a powder of a metal such as iron, zinc, etc. is oxidized with oxygen contained in air, and utilizes heat energy (heat of oxidation) accompanying the oxidation process.

Known heating elements used in heater poultices or disposable pocket heaters utilize heat of oxidation of a metal powder. Processes for the oxidation of a metal powder may be classified roughly into two categories, one a process in which metal oxides or chlorides having an ionization tendency lower than that of metals to be oxidized are used, and the other a process in which oxygen is adsorbed on a non-metal such as active carbon to utilize the oxidation action thereof. However, the former process in which metal oxides or chlorides are used has problems that they have only a short life, the metal oxides used as an oxidizing agent are dangerous and the metal chlorides have toxicity, although a high temperature may be attained (a temperature above 100° C. is possible) and a high calorific value per unit time can be obtained. On the other hand, the latter process in which oxygen in air is adsorbed on active carbon, silica gel, activated alumina or zeolite containing water (in some cases a salt such as sodium chloride is added) to impart an oxidizing capability to the latter has demerits in that the temperature of heat generated is generally low (average temperature being about 60° C. under even the optimum conditions), reaction velocity is low, and calorific value per unit time is low, resulting in a lower effect of warming the body when the heater according to the process is used outdoors in bitter cold winter days. This is because, even if it provides temperatures of 60°–70° C., the temperature will be lowered to 45°–50° C. when the heater is applied to the body, despite its long life and high safety. Packing of the heating element using oxygen in air is effected such that active carbon of a particle size of usually 80–100 mesh impregnated with an aqueous solution of a 10–20% concentrated salt such as sodium chloride, magnesium chloride or calcium chloride is placed on one side of an air-permeable bag, a powder of a metal such as iron or zinc is placed on the other side of the same bag, and the bag is partitioned at the center with, for example, a clip to prevent both powders from being mixed. The whole bag is enclosed airtight in an air-impermeable outer bag. For use, the inner air-permeable bag is taken out from the outer air-impermeable bag, and both powders are then mixed together to generate a heat. Alternatively, a mixture of both powders is previously mixed in an air-permeable bag, but it is isolated from air. For use, it is exposed to air. However, in the case of the former package containing the two different metal powders separately from each other, the metal powders are solidified into granules due to humidity during storage or non-use. Consequently, a sufficient heat generation cannot be obtained in an actual use. In the latter package containing previously mixed metal powder and active carbon powder, the powder coagulation may be less, but it is also caused if nonuse continues for three months or longer. Furthermore, in using active carbon, water penetrates into the pores thereof during storage or non-use to cause a wetting phenomenon, thereby reducing its oxygen-adsorption capability. Consequently, an exothermic reaction speed is slow or the reaction ceases sometimes during the use.

SUMMARY OF THE INVENTION

An object of the present invention is to provide a safety heating element which is safe and non-toxic.

Another object of the invention is to provide a heating element effective for use in an exothermic poultice or disposable pocket heater, the element having a high calorific value per unit time and a longer heating duration.

Still another object of the invention is to provide a heating element which can be stored for an extended time.

DETAILED DESCRIPTION OF THE INVENTION

Figure 1:
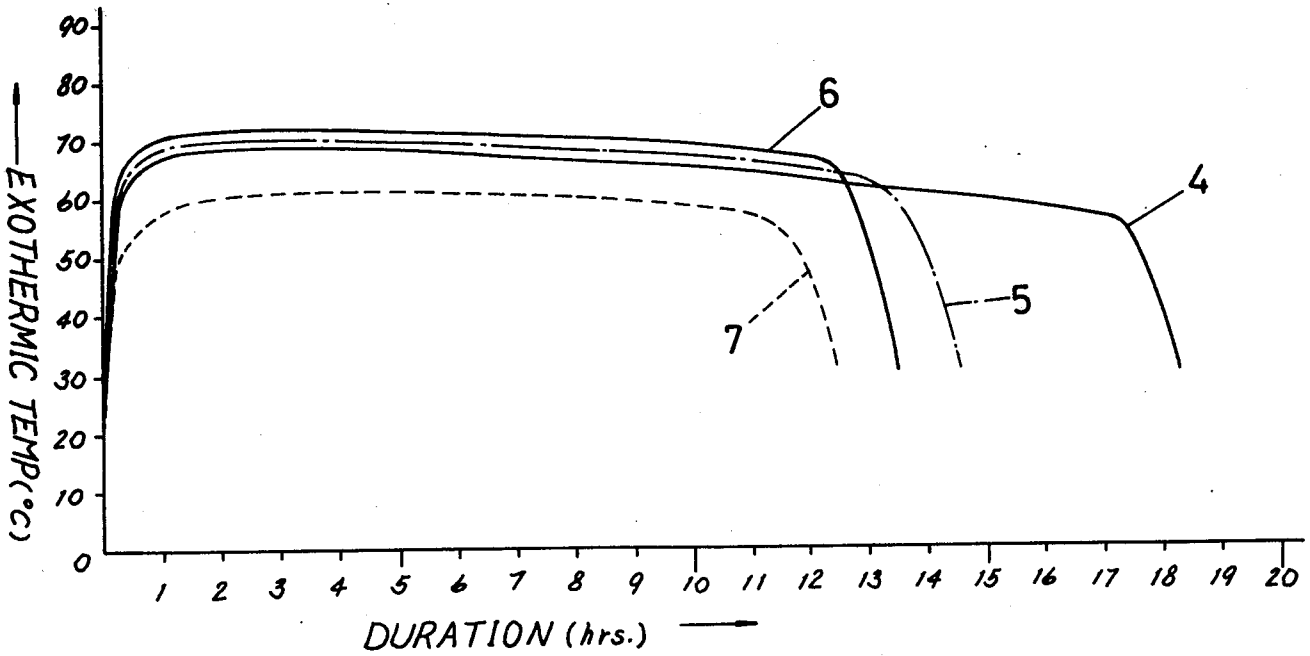
FIG. 1 shows exothermic characteristics curves in the preferred embodiments of the present invention.

In ordinary heating elements in which a metal powder is oxidized in the presence of oxygen and water to utilize heat generated by the oxidation, a chloride such as sodium chloride, calcium chloride or magnesium chloride is used as an adjuvant or an additive, and a metal oxide or metal salt such as cupric chloride, cupric oxide, ferric chloride, silver chloride or manganese dioxide is used as catalyst. Though they are effective for elevating initial temperature of the heating element, it is considered inappropriate to call these metal oxides and metal chlorides catalysts, since they react chemically in the initial stage of reaction and are thereby reduced.

Unlike the oxidation of metals at a high dry temperature (for example, higher than 300° C.) the oxidation at a relatively low temperature (below 100° C.) under a relatively wet condition takes place by an electrochemical reaction. Particularly, since the oxidation reaction is caused by oxygen in air, the same gas electrode reaction as in a fuel cell or air wet cell is applied therein. The requirements for the gas electrodes are high adsorption ability and porosity. Therefore, graphite, active carbon, silica gel, activated alumina and zeolite are usually used as the gas electrodes. Among the porous gas electrodes, active carbon exhibits the highest oxygen adsorbing ability at a temperature near the room temperature if it contains water. In those porous gas electrodes, oxygen must not only be adsorbed on the surface of the electrodes but it must also be activated to such an extent that an electrochemical reaction is caused. Accordingly, in the porous gas electrodes, the adsorption speed of oxygen as reaction gas, and the adsorption energy magnitude are important factors. An agent which controls both the factors is a catalyst. The catalyst must promote the gas adsorption speed, exhibit an adequate adsorption energy, be insoluble in an electrolytic solution and not reactive with the electrolytic solution nor metals to be oxidized, and have a long life. As oxygen is adsorbed on the porous gas electrode, it is immediately reduced electrochemically without being dissociated, as shown in the following formula:

$$O_2 + H_2O + 2e^- \rightarrow HO_2^- + OH^- \quad (1)$$

In this reaction, the above-mentioned catalyst is not so important, but unless $HO_2^-$ decomposition is promoted, the metal oxidation reaction is delayed and calorific value per unit time for the intended heat generation becomes insufficient. For the continued promotion of the $HO_2^-$ decomposition as long as the exothermic reaction takes place, a catalyst is required, and plays an important role. However, a stable, long lasting catalytic function cannot be expected of the above metal salts or metal oxides which are completely reduced in the initial stage of the exothermic reaction.

Fuels used herein as heat energy sources are metals. As suitable fuels, it is observed that simple metals having an ionization tendency higher than that of hydrogen such as iron, zinc, aluminum and magnesium, alloys containing those metals and mixtures, halides, carbides and silicon compounds thereof, all in the form of powders, can be oxidized satisfactorily. Heat per mole of the oxides accompanying the oxidation of each of the metal powders are given in Table 1.

Table 1

| Oxidation reaction | Heat generated ΔH 298° (Kcal/mol.°C.) |
|---|---|
| $2Fe + 3/2\ O_2 \rightarrow Fe_2O_3$ | −196.5 |
| $Zn + \frac{1}{2}\ O_2 \rightarrow ZnO$ | −83.17 |
| $2Al + 3/2\ O_2 \rightarrow Al_2O_3$ | −384 ~ −399 |
| $Mg + \frac{1}{2}\ O_2 \rightarrow MgO$ | −143.84 |

Aluminum generates the highest heat per mole, but it is difficult to oxidize this element completely at a low temperature. Therefore, iron powder is used generally most frequently. An electrochemical reaction of iron powder will be illustrated below. Chemical reaction occurring in the oxidation of iron powder is expressed by the above formula (1). However, in fact, several reaction formulae can be considered, since the electrochemical reaction is accompanied with the oxidation of the iron powder, as shown below:

$$2Fe+3/2O_2 \rightarrow Fe_2O_3 \quad (2)$$

$$Fe \rightarrow Fe^{++}+2e^- \quad (3)$$

Reactions corresponding to formula (3):

$$Fe+2OH^- \rightarrow Fe(OH)_2+2e^- \quad (4)$$

$$Fe^{++} \rightarrow Fe^{+++}+e^- \quad (5)$$

Reactions corresponding to formula (5):

$$Fe(OH)_2+OH^- \rightarrow Fe(OH)_3+e^- \quad (6)$$

$$Fe+2Fe^{+++} \rightarrow 3Fe^{++} \quad (7)$$

Reaction corresponding to formula (7):

$$Fe+2Fe(OH)_3 \rightarrow 3Fe(OH)_2 \quad (8)$$

In all cases, the reaction products obtained in the presence of an electrolytic solution are in the form of a mixture of $Fe_2O_3$, $Fe(OH)_3$ and $Fe(OH)_2$. If the reaction products of, for example, formulae (4) and (1) are combined together, the reaction is completed as follows:

$$2Fe(OH)_2+HO_2^- \rightarrow Fe_2O_3+OH^-+2H_2O \quad (9)$$

As a catalyst for promoting $HO_2^-$ decomposition, a noble metal catalyst such as platinum (Pt), palladium (Pd) or silver (Ag) either in a single form or in the form of a mixture is most suitable.

EXAMPLES

The abovementioned noble metal catalyst is carried on the gas electrode in the electrochemical reaction. As the gas electrode, active carbon is used.

EXAMPLE 1

A solution of 0.01 g of chloroplatinic acid in 50 CC. of water was sprayed uniformly on 100 g of adsorptive coconut active carbon (60–100 μ) while it was stirred. Then, another solution of 1 g of potassium hydroxide in 30 CC. of 3% formaldehyde solution was sprayed on the active carbon, the resultant product was dried in a nitrogen stream at 150°–200° C. and then cooled.

EXAMPLE 2

A solution of 0.1 g of chloroplatinic acid in 50 CC. of water was sprayed uniformly on 100 g of adsorptive coconut active carbon (60–100 μ) and then dried and cooled in the same manner as in Example 1.

EXAMPLE 3

100 Grams of adsorptive coconut active carbon (60–100 μ) are placed in a mixer heated to 40°–60° C. A solution of 0.1 of silver nitrate in 50 CC. of water free of halogen ion is sprayed thereon uniformly under stirring to reduce silver nitrate to metallic silver under the reducing action of the active carbon. Thereafter, the resultant product is dried in a nitrogen stream at 150°–200° C. for 3 hours and then cooled.

Though platinum or silver is used as catalyst in the above examples, osmium and rhodium may also be used as the catalyst in addition to above mentioned palladium. They may be used in the form of a mixture. For example, a mixture of platinum and silver in a ratio of 1:1 carried on active carbon may be used as the catalyst. As for the catalyst carrier, porous adsorptive substances such as silica gel, alumina, zeolite, active china clay and vermiculite may also be used in place of the active carbon. With respect to heat-generating capacity, however, active carbon yields the most excellent results.

Even if the active carbon carrying a catalyst in the above examples is mixed with a metal powder such as iron powder, the electrochemical exothermic reaction does not occur yet. For causing the electrochemical exothermic reaction, it is necessary to ionize the metal. For this purpose, the presence of $H^+$, $Na^+$, $Ca^{++}$, $K^+$, $Mg^{++}$, $Cl^-$, $OH^-$ or $SO_4^{--}$ is preferred. Though the metal can be ionized in the presence of only water, a prolonged time is required with the resulting slow reaction, so that a sufficient temperature cannot be attained. It is therefore required to incorporate therein an ion as an electrolytic solution which helps erode a metal such as iron in the presence of oxygen. The salts required for the ionization of metals include a 5–20% electrolytic solution of, for example, sodium chloride, magnesium chloride, calcium chloride, potassium chloride, sodium carbonate, potassium carbonate or sodium sulfate. Thus, if the electrolytic solution is added to the mixture (heating element) of active carbon-carrying catalyst and iron powder, the electrochemical reaction takes place to generate heat.

The electrolytic solution cannot be used excessively, since if it is used excessively for the reaction of the heating element, the catalyst such as active carbon becomes wet and does not adsorb oxygen gas, and the activation becomes impossible. Particularly, on the surface of the carrier carrying the catalyst, the ideal electrochemical exothermic reaction does not occur unless three phases, i.e., gas phase (oxygen gas), solid phase (catalyst) and liquid phase (electrolytic solution) are always present. However, as the exothermic reaction proceeds, water is evaporated out and the quantity of the aqueous solution becomes smaller in quantity as the time elapses. As a final result, the exothermic reaction ceases.

Containers surrounding the heating element, can be made of a semipermeable membrane or Japanese paper base through which gases such as oxygen are permitted but water vapor is not permitted, the base being lined with a synthetic resin film. In this case, a perforated film of a synthetic resin material such as polyvinyl acetal, polyethylene, polypropylene or vinyl chloride may be used. However, for long-term heat generation, a loss of water is still unavoidable as it continues to evaporate.

For adding an excess amount of aqueous solution in anticipation of the possible vaporization thereof as well as for keeping the three phases present, the catalyst surface is subjected to a water-proofing treatment to such an extent that the three-phase state can be retained.

As materials for use in the water-proofing treatment without lowering the catalytic capacity significantly, natural and synthetic resins such as paraffin, polyethylene, polystyrene, polytetrafluoroethylene, palmitic acid, stearic acid, polyvinyl alcohol, rosin and silicon resin can be used. 0.1–1% in liquid of the above materials is added to an organic solvent such as acetone, toluene, isopropyl alcohol, benzene or ethyl alcohol or water. The resulting solution is sprayed on the carrier carrying the catalyst or, alternatively, the carrier carrying the catalyst is immersed therein and then it is dried to form a very thin semipermeable membrane on the surface of the catalyst. Thus, even if excessive aqueous solution is added thereto, the three-phase state can be kept and water does not run short during the long-lasting exothermic reaction.

The metal powder and the catalyst-carrying active carbon impregnated with the electrolytic solution may be packed separately from each other in a bag so that the reaction cannot be caused before the actual use. However, the metal powder is solidified into granules due to water contained in the electrolytic solution during the non-use period, and the metal powder cannot be mixed well with the catalyst-carrying carbon at the time of the actual use. Therefore, it may be preferred in some respects that the metal powder be previously mixed with the catalyst-carrying active carbon and the separate electrolytic solution is added thereto when the heater is actually used. In this case, however, the metal powder tends to be solidified into granules when the electrolytic solution is added, or in other words, during the exothermic reaction. In order to prevent the solidification, it is effective to form a film of a fatty acid such as stearic acid, palmitic acid or metallic soap on the surface of the metal powder. The film is formed by, for example, spraying a 0.5–1% solution of stearic acid in acetone or methyl alcohol on the surface of the metal powder and then removing the solvent therefrom.

The following examples show exothermic reaction by using the catalyst-carrying active carbon, metal powder and electrolytic solution.

EXAMPLE 4

This example shows a case in which the catalyst-carrying active carbon is not subjected to water-proofing treatment.

| | |
|---|---|
| Catalyst-carrying active carbon of Example 3 | 20 g |
| Electrolytic solution: | |
| 10% aqueous magnesium chloride solution | 15 CC. |
| Metal powder: | |
| Iron powder (100 μ) containing 4% of carbon | 20 g |

EXAMPLE 5

| | |
|---|---|
| Catalyst-carrying active carbon of Example 1 | 20 g |
| Electrolytic solution | The same as in Example 4 |
| Metal powder | |

EXAMPLE 6

| | |
|---|---|
| Catalyst-carrying active carbon of Example 2 | 20 g |
| Electrolytic solution | The same as in Example 4 |
| Metal powder | |

The catalyst-carrying active carbons in Examples 5 and 6 were subjected to water-proofing treatment with 0.5% paraffin solution.

EXAMPLE 7

| | |
|---|---|
| Active carbon (60–100 μ) free of catalyst | 20 g |
| Electrolytic solution | The same as in Example 4 |
| Metal powder | |

The heating elements of Examples 4 through 7 were placed in a bag of an air-permeability of 100;14 120 CC/dm$^2$.mm to cause the exothermic reaction. Exothermic temperatures and exothermic time as shown in FIG. 1 were obtained. In the figure, numbers given to the curves indicate corresponding example numbers. With a noble metal catalyst carried on active carbon, a 10° C. higher exothermic temperature and a 6–8 hours longer exothermic time in average could be obtained as compared with those in Example 7.

In case a film of stearic acid, palmitic acid or metallic soap is formed on the surface of the iron powder for preventing the solidification into granules, the exothermic temperature is lowered by 2°–3° C., but the heating duration remains almost unchanged. After 6 months' storage at room temperature the iron powder was not solidified into granules.

Figure 2:
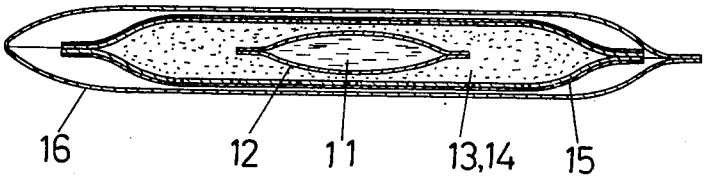
FIG. 2 is a cross section showing a disposable pocket heater containing the product according to the present invention.
Figure 3:
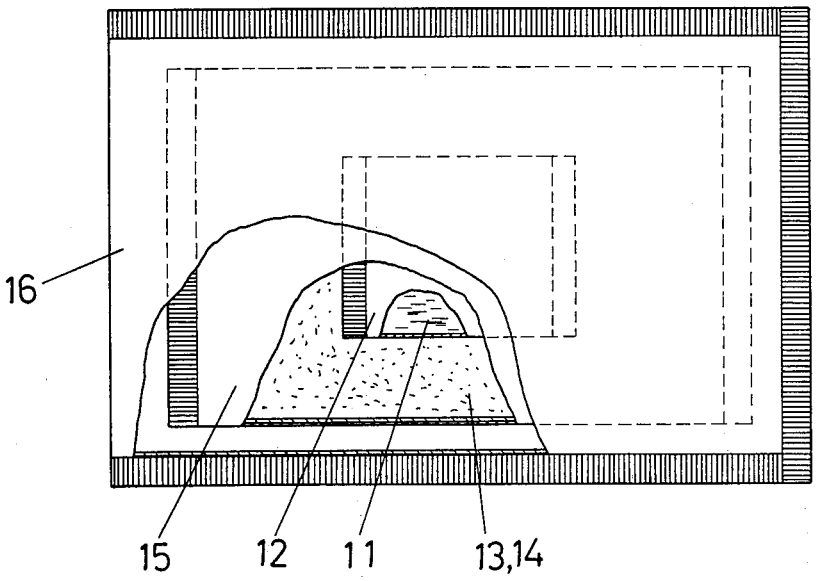
FIG. 3 is a partially broken-away plan view of the same.

A disposable pocket heater containing heating elements and electrolytic solutions of Examples 4–6 is shown in FIGS. 2 and 3. An electrolytic solution 11 is placed in a water-proofed, air-tight inner bag 12 made of polypropylene, polyethylene or the like. A metal powder 13 such as iron powder is previously mixed with an active carbon 14 carrying a catalyst. They are sealed in an air-permeable bag 15 made of, for example, a Japanese paper lined with a perforated polyethylene sheet. Further, the outer bag 15 is sealed air-tight in a beautifully designed bag 16 of a low air-permeability made of, for example, polypropylene so that the metal powder is not oxidized with humidity during storage.

When the disposable pocket heater is initially used, the outer bag 15 is taken out from the beautifully designed bag 16 and an external force is applied onto the bag 15 and into the inner bag 12 by, for example, lightly tapping the bag 15 to break the inner bag 12 open, whereby the electrolytic solution 11 flows into the heating element. Thus, heat is generated as shown in FIG. 1. Even if a mixture of the electrolytic solution 11 and the heating element is employed, the exothermic reaction does not take place, since the introduction of oxygen in air into the outer bag 15 is inhibited by the outer bag 16. The breakage of the bag 16 begins the immediate exothermic reaction.

The present invention described heretofore, provides a high temperature heating which lasts for a long time, because a heating element comprises a noble metal catalyst, an ion-containing solution and a metal powder. Water-proofing treatment of the catalyst carrier can keep the initial exothermic state effective till the completion of the exothermic reaction. Further, a film of a fatty acid or metallic soap formed on the metal powder can prevent the solidification of metal powder into its granules. The heating element according to the invention can retain its heating capability as long as it remains in non-use or is stored.

Although the present invention has been described with reference to the examples thereof, it should be understood that various changes and modifications may be made without departing from the spirit and scope of the invention.

What is claimed is:

1. In a heating element in which heat is generated by the electrochemical oxidation of an oxidizable powdered metallic substance having a higher ionization tendency than hydrogen, the improvement wherein there is employed as an oxidation catalyst, at least one member selected from the group consisting of platinum, palladium, rhodium and silver.

2. The heating element of claim 1 wherein the oxidizable powdered metallic substance having an ionization tendency higher than that of hydrogen is selected from the group consisting of iron, zinc, aluminum, magnesium, alloys and mixtures of these metals, halides, carbides and silicon compounds thereof.

3. The heating element according to claim 1 in which the catalyst is supported by a carrier.

4. The heating element according to claim 3 wherein the catalyst supported by the carrier has an air permeable, water-repellant coating thereon.

5. The heating element according to claim 4 wherein the coating is a thin film of fatty acid or metallic soap.

* * * * *